US011846119B2

(12) United States Patent
Kleynerman

(10) Patent No.: US 11,846,119 B2
(45) Date of Patent: Dec. 19, 2023

(54) SINGLE USE ELECTRONIC CABLE LOCK

(71) Applicant: Gregory Kleynerman, Fox Point, WI (US)

(72) Inventor: Gregory Kleynerman, Fox Point, WI (US)

( * ) Notice: Subject to any disclaimer, the term of this patent is extended or adjusted under 35 U.S.C. 154(b) by 4 days.

(21) Appl. No.: 17/727,083

(22) Filed: Apr. 22, 2022

(65) Prior Publication Data

US 2023/0340803 A1 Oct. 26, 2023

(51) Int. Cl.
*E05B 47/00* (2006.01)

(52) U.S. Cl.
CPC .. *E05B 47/0001* (2013.01); *E05B 2047/0014* (2013.01); *E05B 2047/0058* (2013.01)

(58) Field of Classification Search
CPC ..... E05B 47/0001; E05B 2047/0014; E05B 2047/0058
See application file for complete search history.

(56) References Cited

U.S. PATENT DOCUMENTS 2,166,058 A * 7/1939 Kirk ..... H01H 33/52 70/265
5,743,574 A * 4/1998 Kohn ..... G09F 3/0358 292/315
5,820,176 A * 10/1998 Leon ..... F16G 11/108 292/323
7,073,828 B2 7/2006 Foigel et al.
7,172,225 B2 2/2007 Foigel et al.
7,478,847 B2 * 1/2009 Kleynerman ..... G09F 3/037 292/315
2005/0231365 A1 * 10/2005 Tester ..... G09F 3/0347 292/307 R
2007/0120381 A1 * 5/2007 Ehrensvard ..... G09F 3/0358 292/307 R
2009/0320532 A1 * 12/2009 Bonato ..... E05B 73/0005 70/57.1
2013/0200637 A1 * 8/2013 Dreisbach ..... G09F 3/0352 292/323

* cited by examiner

*Primary Examiner* — Mark A Williams
(74) *Attorney, Agent, or Firm* — James Earl Lowe, Jr.

(57) ABSTRACT

A cable lock with a bare wire cable, the cable lock including a lock unit for securely grasping the free end of the cable. The cable lock also includes a cable testing mechanism comprising a first cable contact that engages the cable, and a second cable contact that engages the cable. The cable lock also includes an electrical current generating and measuring mechanism powered by a battery, the mechanism being in electric communication with one of the cable contacts for putting current into the cable, and in electric communication with the other of the cable contacts for reading current passing through the cable.

3 Claims, 5 Drawing Sheets

SINGLE USE ELECTRONIC CABLE LOCK

BACKGROUND

This disclosure pertains to cable locks, and, more particularly, to single use electronic cable locks.

It is known to provide a cable lock unit 20 with a bare wire cable 36 having one end 37 attached to a cable lock body 32 and having a free end 39. The cable lock 20 is used to lock, for example, a door with two spaced apart pieces to be locked together, by feeding the cable free end through openings in the spaced apart pieces to be locked together, and then passing the free end of the cable back into the cable lock opening. An example of such a lock unit is in U.S. Pat. No. 7,073,828 issued 11 Jul. 2006, which is incorporated herein by reference.

As shown in FIG. 1, the conventional cable lock 20 has a locked state or locked condition (see FIG. 2) in which the cable 36 is inserted into the body 32, and an unlocked state or unlocked condition (see FIG. 1) in which the cable 36 is not inserted into the body 32. In some embodiments, the cable 36 is inserted substantially along an insertion axis 40 passing into and/or through the body. The body 32 includes a housing 44 defining a cavity 48 therein within which internal components of the cable lock 20 are housed. In the illustrated embodiment, the housing 44 is substantially cylindrical and has an open end 56 and a closed end 52 defined by a wall of the housing 44.

An inlet 60 is defined in an enclosed end 52 of the housing 44 for passage of the cable 36 into and/or through the housing 44. The inlet 60 is substantially aligned with an insertion axis 40 of the housing 44 (described above). The body 32 also has another portion 64 to which the cable 36 is permanently attached. The illustrated portion 64 extends from the housing 44 and defines an aperture 68 therein in which the cable 36 is received. The cable 36 is permanently secured to this portion 64 of the body 32 in several manners, such as by crimping the portion 64 of the body 32 defining the aperture 68, thereby compressing and securing the cable 36 within the cable aperture 68. In some embodiments, one or more visual indicators 72 can be located on each side of the crimp 64 for indicating whether the portion 64 of the body to which the cable 36 is permanently secured has been tampered with.

SUMMARY

Disclosed is a cable lock with a bare wire cable, the cable lock including a lock unit for securely grasping the free end of the cable. The cable lock also includes a cable testing mechanism comprising a first cable contact that engages the cable, and a second cable contact that engages the cable. The cable lock also includes an electrical current generating and measuring mechanism powered by a battery, the mechanism being in electric communication with one of the cable contacts for putting current into the cable, and in electric communication with the other of the cable contacts for reading current passing through the cable.

Figure 1:
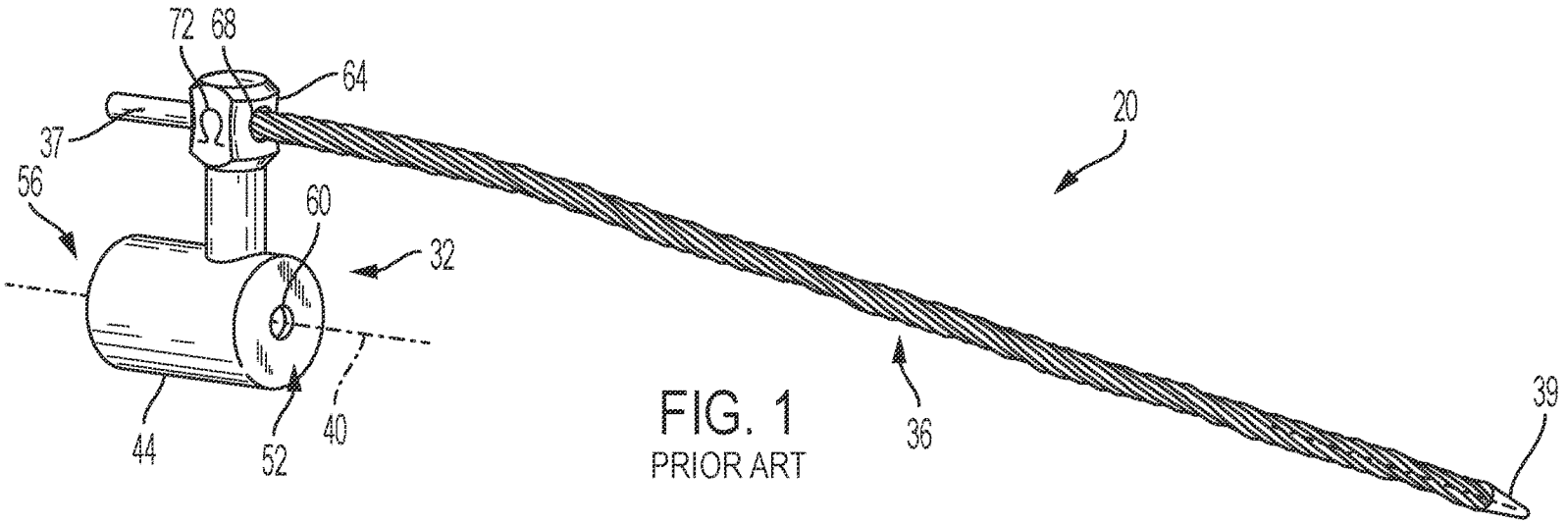
FIG. 1 PRIOR ART
FIG. 1 is a perspective view of a conventional cable lock shown in a unlocked state.
Figure 2:
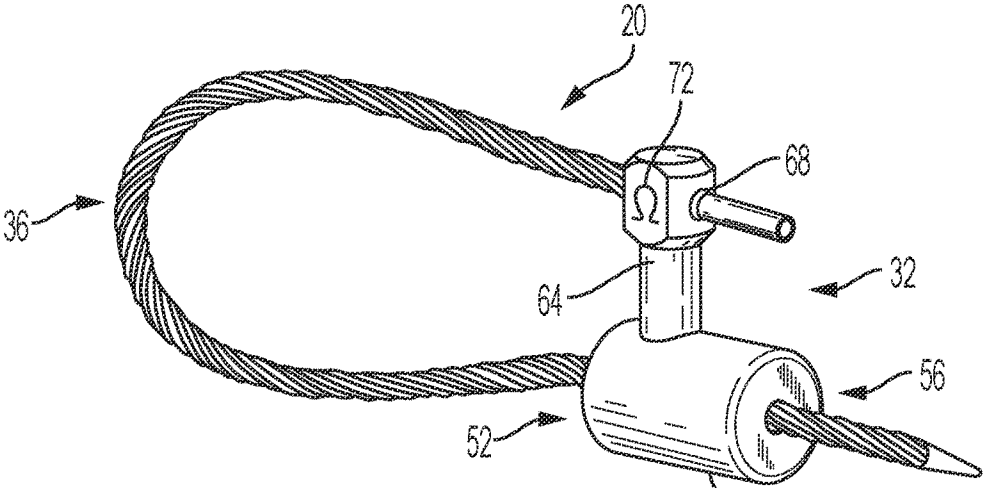
FIG. 2 PRIOR ART
FIG. 2 is a perspective view of the cable lock shown in FIG. 1, shown in a locked state.

Before one embodiment of the disclosure is explained in detail, it is to be understood that the disclosure is not limited in its application to the details of the construction and the arrangements of components set forth in the following description or illustrated in the drawings. The disclosure is capable of other embodiments and of being practiced or being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof.

DESCRIPTION OF THE PREFERRED EMBODIMENT

Figure 3:
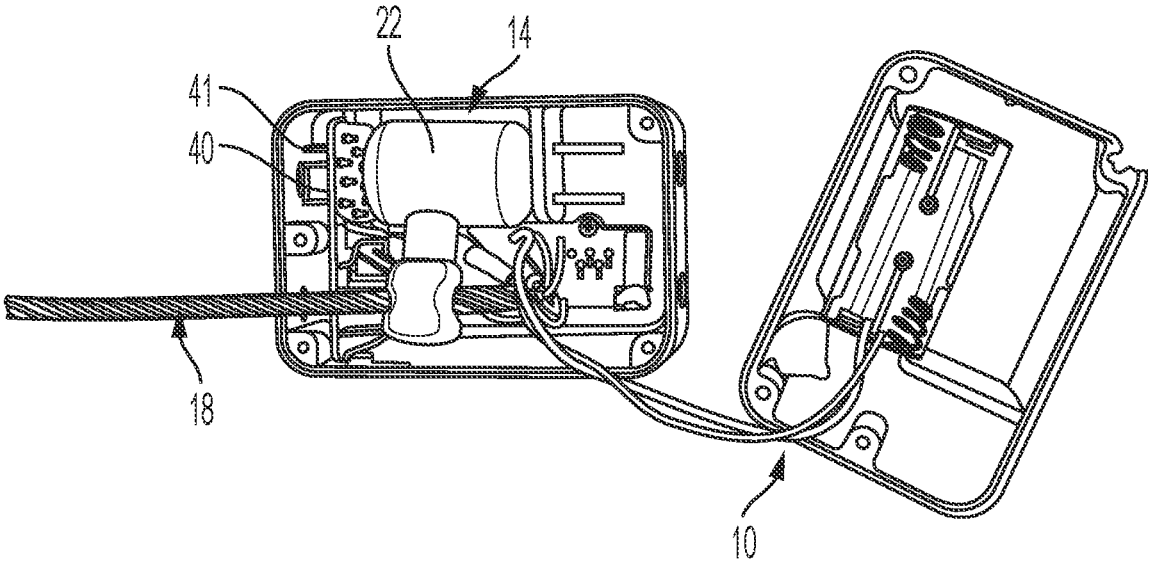
FIG. 3 is front perspective view of the two halves of a single use electronic cable lock according to this disclosure.
Figure 4:
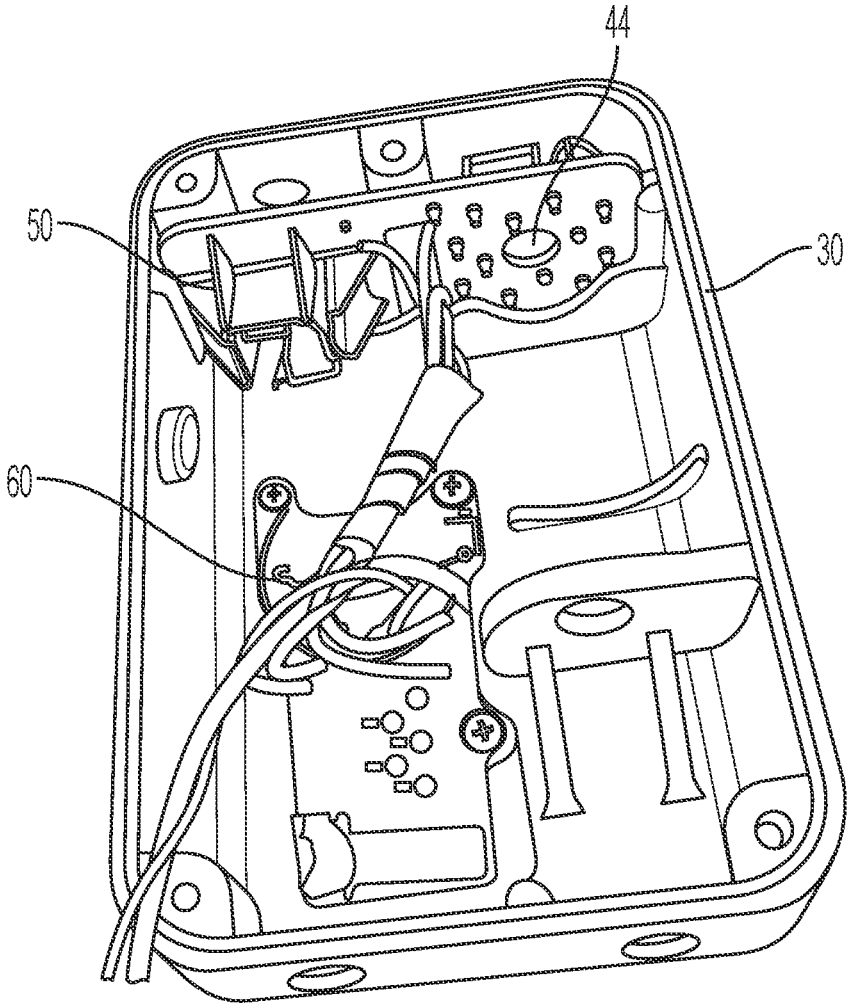
FIG. 4 is a side perspective view of one of the halves of the cable lock in FIG. 1 picturing one of the circuit board contacts.
Figure 5:
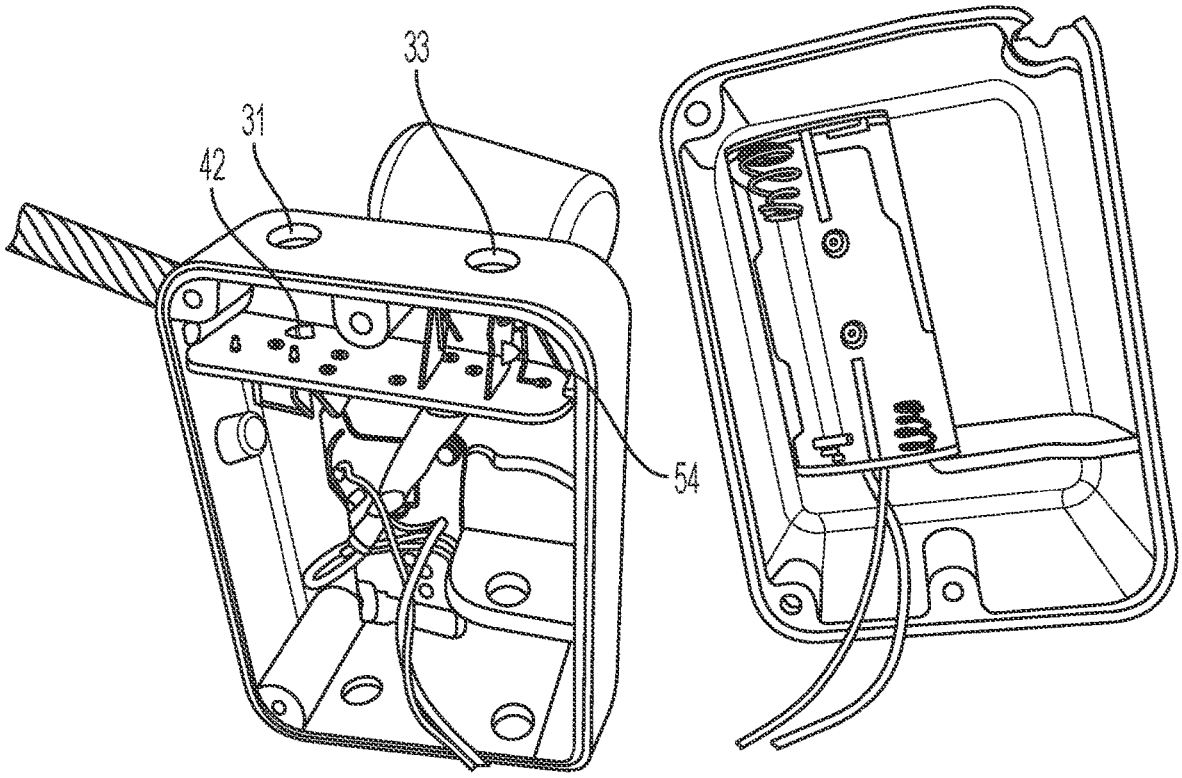
FIG. 5 is a side perspective view of the cable lock in FIG. 1 picturing the other of the circuit board contacts.
Figure 6:
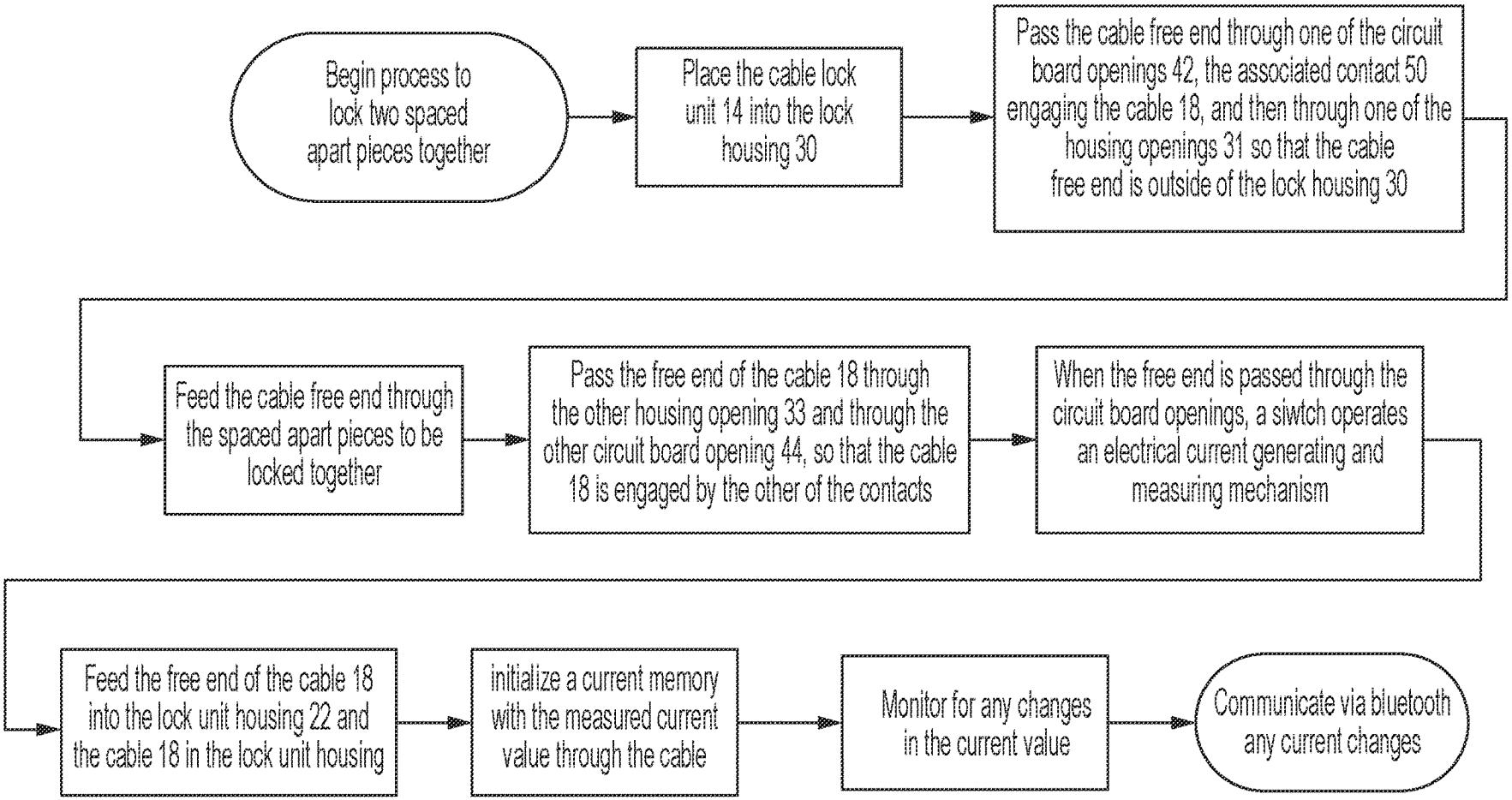
FIG. 6 is a schematic illustration of a method of using the electronic cable lock according to this disclosure.

As illustrated in FIGS. 3 to 6, disclosed is a method of producing and using a single use electronic cable lock 10. The single use electronic cable lock 10 includes a cable lock unit 14 therein, such as the cable lock unit 20 described above. In other embodiments, other cable locks (not shown) with a bare wire cable 18 having one end attached to a cable lock body 22 and a free end securely attachable to the cable lock body 22 can be used. The single use electronic cable lock 10 also includes a lock housing 30 having space therein for a battery and for the cable lock unit 14. The lock housing 30 also has two spaced apart openings 31 and 33 (see FIG. 5) into the housing 30. A circuit board 40 is mounted in the lock housing 30, and the circuit board 40 has two spaced apart openings 42 (see FIG. 5) and 44 (see FIG. 4) therethrough.

The cable lock 10 also includes a cable testing mechanism comprising a first cable contact 50 that can engage the cable 18 when the cable 18 is passed through one of the circuit board openings 31, and a second cable contact 54 that can engage the cable 18 when the cable 18 is passed through the other of the circuit board openings 33. More particularly, in the disclosed embodiment, each contact includes two contact points for engaging the bare wire cable 18.

The cable lock 10 also includes an electrical current generating and measuring mechanism 60 powered by the battery and including a current memory, the mechanism 60 being in electric communication with one of the cable contacts for putting current into the cable, and in electric communication with the other of the cable contacts for reading current passing through the cable. The battery can power the electronic single use cable lock for about 30 days.

The cable lock 10 is used to lock two spaced apart pieces (not shown) to be locked together by the following steps: placing the cable lock unit 14 into the lock housing 30, then passing the cable free end through one of the circuit board openings 42, the associated contact 50 engaging the cable 18, and then through one of the housing openings 31 so that the cable free end is outside of the lock housing 30. The cable free end is then feed through the spaced apart pieces (not shown) to be locked together, and then the free end of the cable 18 is passed through the other housing opening 33 and through the other circuit board opening 44, so that the cable 18 is engaged by the other of the contacts 54. The free end of the cable 18 is then feed into the lock unit housing 22 and secured in the lock unit housing 22.

When the free end of the cable is passed into the housing through the other housing opening and through the other circuit board opening, a switch 41 operates the electrical current generating and measuring mechanism, passing current through the cable from one contact to the other. At the time of such switch sensing a cable is in place, the memory is initialized with an initial cable current value. Changes to the cable current value indicate a change in the condition of the cable, such as the cable having been severed or severed and reconnected, or whether the cable length between the contacts has changed.

The cable lock further includes a wireless communication module in electric communication with the electrical current generating and measuring mechanism, the module periodically providing current information to a communication receiver outside of the housing when the mechanism is switched on. More particularly, in the disclosed embodiment, the module produces a Bluetooth signal with a unique product ID and information about changes I the value of the current through the cable. In this manner, remote monitoring of the condition of the cable lock is possible. When desired, the cable 18 is cut to free the two spaced apart pieces.

Also disclosed is a method of monitoring electronic locks comprising the steps of periodically producing a Bluetooth signal indicating whether the lock is secure or it has been tampered with, the Bluetooth signal providing a unique product ID and information about the condition of the cable, and then by providing a spaced apart plurality of communication receivers in the form of high gain antennas provided at 200-meter lengths along a railroad track to monitor the location of the electronic locks and to indicate whether any of the locks have been tampered with.

Various other features of this disclosure are set forth in the following claims.

The invention claimed is:

1. A cable lock adapted to receive a bare wire lock, the bare wire lock including a cable lock unit and a bare wire cable having one end attached to the cable lock unit and the cable having a free end, the lock unit having therein a lock unit opening for receiving and securely grasping the free end of the cable, the cable lock including:

a lock housing having therein space for a battery, space for the cable lock unit, and two spaced apart openings extending from an outer surface of the housing into the housing, a circuit board mounted in the lock housing, the circuit board having two spaced apart openings therethrough, each respectively aligned with a respective one of the housing openings, a cable testing mechanism comprising a first cable contact mounted on the circuit board to engage the cable when one part of the cable is passed through one of the circuit board openings, and a second cable contact mounted on the circuit board that can engage the cable when another part the cable is passed through the other of the circuit board openings, and an electrical current generating and measuring mechanism powered by the battery, the mechanism being in electric communication with one of the cable contacts for putting current into the cable, and in electric communication with the other of the cable contacts for the cable testing mechanism to read current passing through the cable.

2. The cable lock according to claim 1 wherein the cable lock further includes a switch that operates the electrical current generating and measuring mechanism when a cable extends between both contacts, and a wireless communication module in electric communication with the electrical current generating and measuring mechanism, the module periodically providing current information to a communication receiver outside of the housing when the mechanism is switched on.

3. The cable lock according to claim 2 wherein the cable lock further includes a memory, such switch initializing the memory with an initial cable current value.

* * * * *